US011110510B2

(12) United States Patent
Aoki

(10) Patent No.: US 11,110,510 B2
(45) Date of Patent: Sep. 7, 2021

(54) EXPANDABLE AGGREGATE MIXTURE FOR MOLDS, MOLD, AND METHOD FOR MANUFACTURING MOLD

(71) Applicant: Sintokogio, Ltd., Nagoya (JP)

(72) Inventor: Tomohiro Aoki, Toyokawa (JP)

(73) Assignee: Sintokogio, Ltd., Nagoya (JP)

( * ) Notice: Subject to any disclaimer, the term of this patent is extended or adjusted under 35 U.S.C. 154(b) by 0 days.

(21) Appl. No.: 16/761,896

(22) PCT Filed: Oct. 16, 2018

(86) PCT No.: PCT/JP2018/038561
§ 371 (c)(1),
(2) Date: May 6, 2020

(87) PCT Pub. No.: WO2019/093083
PCT Pub. Date: May 16, 2019

(65) Prior Publication Data

US 2021/0170476 A1 Jun. 10, 2021

(30) Foreign Application Priority Data

Nov. 9, 2017 (JP) ..... JP2017-216183

(51) Int. Cl.

| | |
|---|---|
| ***B22C 1/02*** | (2006.01) |
| ***B22C 1/18*** | (2006.01) |
| ***B22C 1/20*** | (2006.01) |
| ***B22C 9/02*** | (2006.01) |

(52) U.S. Cl.
CPC ..... *B22C 1/02* (2013.01); *B22C 1/20* (2013.01); *B22C 9/02* (2013.01); *B22C 1/181* (2013.01); *B22C 1/188* (2013.01)

(58) Field of Classification Search
CPC ..... B22C 1/02; B22C 1/18; B22C 1/20
See application file for complete search history.

(56) References Cited

U.S. PATENT DOCUMENTS

| | | | | |
|---|---|---|---|---|
| 4,284,121 | A * | 8/1981 | Horton | B22C 1/167 106/38.3 |
| 4,691,756 | A * | 9/1987 | Suzuki | B22C 1/02 164/21 |
| 2007/0066707 | A1* | 3/2007 | Zenpo | B22C 15/08 523/139 |
| 2007/0196529 | A1 | 8/2007 | Zenpo et al. | |
| 2016/0121388 | A1* | 5/2016 | Aoki | B22C 9/10 164/12 |

FOREIGN PATENT DOCUMENTS

| | | |
|---|---|---|
| JP | S49-043054 | 4/1974 |
| JP | 2002239681 A | 8/2002 |

(Continued)

OTHER PUBLICATIONS

EPO machine translation of JP 2013-094834 A (Year: 2013).*

(Continued)

*Primary Examiner* — Kevin E Yoon
(74) *Attorney, Agent, or Firm* — Taft Stettinius & Hollister LLP

(57) ABSTRACT

An expandable aggregate mixture for a mold, which contains an aggregate, a water-soluble binder, a water-soluble foaming agent, water, and spherical metal oxide particles.

19 Claims, 2 Drawing Sheets

(56) References Cited

FOREIGN PATENT DOCUMENTS

| | | | |
|---|---|---|---|
| JP | 2005089984 | A | 4/2005 |
| JP | 4920794 | B1 | 4/2012 |
| JP | 4953511 | B2 | 6/2012 |
| JP | 5102619 | B2 | 12/2012 |
| JP | 2013-094834 | A | 5/2013 |
| WO | 2005089984 | A1 | 9/2005 |

OTHER PUBLICATIONS

International Search Report, Japan Patent Office, International Application No. PCT/JP2018/038581, dated Dec. 25, 2018, 3 pages.
Written Opinion of the International Searching Authority, Japan Patent Office, International Application No. PCT/JP2018/038561, dated Dec. 25, 2018, 4 pages.

* cited by examiner

EXPANDABLE AGGREGATE MIXTURE FOR MOLDS, MOLD, AND METHOD FOR MANUFACTURING MOLD

CROSS-REFERENCE TO RELATED APPLICATIONS

This application is a U.S. National Phase Application of International Patent Application No. PCT/JP2018/038561, which was filed on Oct. 16, 2018, and which claims the benefit of, and priority to, Japanese Patent Application No. 2017-216183, which was filed on Nov. 9, 2017. Each of the above applications is expressly incorporated by reference herein in its entirety.

TECHNICAL FIELD

The present invention relates to an expandable aggregate mixture for molds, a mold, and a method for manufacturing the mold.

BACKGROUND ART

Conventionally, manufacture of a mold by filling a space (cavity) in a metal mold with an aggregate composition for a mold, the aggregate composition containing an aggregate and a binder, in accordance with a press fitting system is known.

For example, Japanese Patent No. 4953511 discloses a casting sand composition in which hollow spherical particles of an organic material or an inorganic material, which have been surface-treated with a silicon-based compound, are added in order to improve the fluidity of the casting sand composition.

Further, Japanese Patent No. 4920794 discloses addition of an acidic spherical non-crystalline silica or spherical non-crystalline alumina, as a fluidizing agent and a curing agent, to a mold material including an alkali silicate as a binder, in order to develop the strength of the mold material and to improve packing property.

Further, Japanese Patent No. 5102619 discloses that, by the use of water glass and a bonding agent containing particulate non-crystal type silicon dioxide in a molding material mixture for manufacturing a mold, the strength of the mold is significantly improved just after molding and curing, and also after storage under high humidity.

Furthermore, the Re-publication of PCT International Publication No. 2005-89984 discloses that, by preparing a foamed mixture obtained through stirring a particulate aggregate, a water-soluble binder, and water, and effectively using the foamed mixture, filling of a space (cavity) in a metal mold with the foamed mixture can be ensured sufficiently.

SUMMARY OF INVENTION

Technical Problem

For example, as described in Japanese Patent No. 4953511, various methods for the improvement in the fluidity of an aggregate mixture for a mold (a casting sand composition) are known. However, even if the fluidity is improved to a certain extent, there is a limit to forming a mold having a complicated shape or a thin shape. Therefore, further improvement in fluidity has been required. Similarly, also with regard to Japanese Patent No. 4920794 and Japanese Patent No. 5102619, improvement in the fluidity of the aggregate mixture for a mold has been required.

On the other hand, a substance obtained by foaming an aggregate mixture, which has an improved fluidity and use of which sufficiently ensures the packing property, has been disclosed (for example, the Re-publication of PCT International Publication No. 2005-89984 and the like). However, in a mold obtained by using such an expandable aggregate mixture, a water-soluble binder is specifically disposed at the surface layer side (outer peripheral surface side) of the mold. When a cast product is casted utilizing this mold, a phenomenon occurs in which the aggregate (hereinafter, also referred to as "sand") adheres to the surface of the cast product due to the influence of the water-soluble binder.

Accordingly, it is an object of the invention to provide an expandable aggregate mixture for a mold, which reduces the adhesion of sand to the surface of the cast product, in an expandable aggregate mixture having fluidity applicable for molds with a complicated shape or a thin shape; a mold; and a method for manufacturing the mold.

Solution to Problem

Means for addressing the above problems are as follows.

<1> An expandable aggregate mixture for a mold, the expandable aggregate mixture including an aggregate, a water-soluble binder, a water-soluble foaming agent, water, and spherical metal oxide particles.

<2> The expandable aggregate mixture for a mold according to <1>, wherein the metal oxide particles are neutral or alkaline.

<3> The expandable aggregate mixture for a mold according to <1> or <2>, including, as the metal oxide particle, at least one selected from the group consisting of an alumina particle and a silica particle.

<4> The expandable aggregate mixture for a mold according to any one of <1> to <3>, wherein the metal oxide particles have a particle diameter of from 0.1 μm to 5 μm.

<5> The expandable aggregate mixture for a mold according to any one of <1> to <4>, including spherical artificial sand as the aggregate.

<6> The expandable aggregate mixture for a mold according to any one of <1> to <5>, including an alkali silicate as the water-soluble binder.

<7> The expandable aggregate mixture for a mold according to <6>, including, as the water-soluble binder, at least one selected from the group consisting of sodium silicate and potassium silicate.

<8> The expandable aggregate mixture for a mold according to any one of <1> to <5>, including, as the water-soluble binder, at least one selected from the binder group consisting of polyvinyl alcohol and derivatives thereof, saponin, starch and derivatives thereof, and additional sugars.

<9> The expandable aggregate mixture for a mold according to any one of <1> to <8>, including, as the water-soluble foaming agent, at least one selected from the group consisting of an anionic surfactant, a nonionic surfactant, and an amphoteric surfactant.

<10> The expandable aggregate mixture for a mold according to any one of <1> to <9>, wherein a content of the metal oxide particles is from 0.001% by mass to 0.5% by mass with respect to the aggregate.

<11> The expandable aggregate mixture for a mold according to any one of <1> to <10>, wherein a content of the water-soluble binder is from 0.1% by mass to 20% by mass with respect to the aggregate.

<12> The expandable aggregate mixture for a mold according to any one of <1> to <11>, wherein a content of the water-soluble foaming agent is from 0.005% by mass to 0.1% by mass with respect to the aggregate.

<13> The expandable aggregate mixture for a mold according to any one of <1> to <12>, wherein a content of the water is from 1.0% by mass to 10% by mass with respect to the aggregate.

<14> The expandable aggregate mixture for a mold according to any one of <1> to <13>, having a viscosity of from 0.5 Pa·s to 10 Pa·s.

<15> A mold, including the expandable aggregate mixture for a mold according to any one of <1> to <14>, in which the water-soluble binder and the metal oxide particles are specifically disposed at an outer peripheral surface side thereof.

<16> A method for manufacturing a mold, the method including:

a filling process of filling a space for manufacturing a mold in a metal mold with the expandable aggregate mixture for a mold according to any one of <1> to <14>, in which the filling of the space for manufacturing a mold is performed by injection;

a mold manufacturing process of manufacturing an aggregate mold by evaporating moisture from the expandable aggregate mixture that has been filled, to solidify the expandable aggregate mixture;

a removal process of removing the aggregate mold, that has been manufactured, from the space for manufacturing a mold; and before the filling process, an expandable aggregate mixture preparation process of preparing an expandable aggregate mixture by mixing a mixture obtained by mixing the water-soluble binder and the metal oxide particles, an aggregate, a surfactant and water.

Advantageous Effects of Invention

According to the invention, an expandable aggregate mixture for a mold, which reduces the adhesion of sand to the surface of the cast product, a mold, and a method for manufacturing the mold may be provided.

DESCRIPTION OF EMBODIMENTS

Figure 1A:
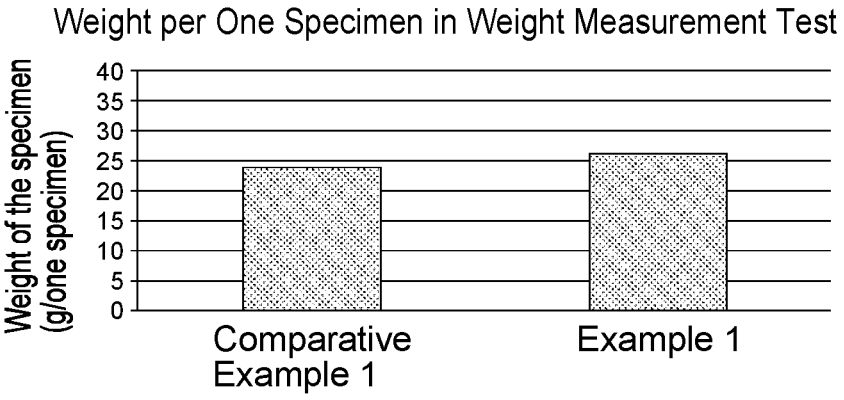
FIG. 1A is a graph showing the results of a weight measurement test in Example 1 and Comparative Example 1.

Hereinafter, embodiments of the present invention will be described in detail.

The expandable aggregate mixture for a mold (hereinafter, also referred to as, simply, "expandable aggregate mixture") according to the embodiment of the invention contains an aggregate, a water-soluble binder, a water-soluble foaming agent, water, and spherical metal oxide particles.

The expandable aggregate mixture for a mold according to the embodiment of the invention is a composition to be used as a material of a mold (an aggregate mold). Note that, in the present specification, the term "mold" is used in a sense that encompasses a core.

By having such a configuration as described above, the expandable aggregate mixture for a mold according to the embodiment of the invention can reduce the adhesion of sand to the surface of the cast product.

The reason why this effect is exerted is guessed as follows.

The expandable aggregate mixture for a mold according to the embodiment of the invention includes spherical metal oxide particles. When manufacturing a mold (for example, a "core" or the like) by using this expandable aggregate mixture, the metal oxide particles are specifically disposed at the surface layer side (outer peripheral surface side) of the mold, together with the water-soluble binder that is included in the expandable aggregate mixture for a mold. The metal oxide particles that are specifically disposed at the surface layer side exhibit a lotus effect with respect to the cast product, and thus, the adhesion of sand to the surface of the cast product due to the water-soluble binder can be suppressed.

Further, in the expandable aggregate mixture according to the embodiment of the invention, the amount of the water-soluble binder to be used is decreased.

The reason why this effect is exerted is guessed as follows.

It is thought that, in the expandable aggregate mixture for a mold according to the embodiment of the invention, by the inclusion of a spherical metal oxide particle, the metal oxide particle plays a role of a rolling element (a roller) that makes the flow smooth, in the flowing expandable aggregate mixture for a mold, at the time of molding. According to this effect (bearing effect) of making the flow of the expandable aggregate mixture for a mold smooth by the metal oxide particle, the packing density of the expandable aggregate mixture for a mold can be enhanced.

As a result, as compared with the case of using an expandable aggregate mixture for a mold, which does not include a metal oxide particle, the packing density is enhanced, and thus, the strength of the obtained cast product is enhanced. Therefore, even if the used amount of the water-soluble binder is decreased, a mold having a desired strength can be obtained.

Next, each of the components that constitute the expandable aggregate mixture for a mold according to the embodiment of the invention will be described in detail.

[Aggregate]

The aggregate in the embodiment of the invention is not particularly limited, and any conventionally known aggregate may be used. Examples thereof include sand such as silica sand, alumina sand, olivine sand, chromite sand, zirconium sand, mullite sand, or the like. In addition, various kinds of artificial sand (so-called artificial aggregates) may be used.

Among them, artificial sand is particularly preferable from the viewpoint that sufficient strength of the mold is easily obtained even when the addition amount of the binder respect to the aggregate is decreased, and that a high rate of aggregate reclamation is easily obtained.

A particle diameter of the aggregate in the embodiment of the invention is preferably from 10 μm to 1 mm, and more preferably from 50 μm to 500 μm.

When the particle diameter is equal to or less than the upper limit value described above, an excellent fluidity is obtained and the packing property in manufacturing an aggregate mold is improved. When the particle diameter is equal to or more than the lower limit value described above, the breathability of the aggregate mold is maintained favorable.

The particle diameter of the aggregate may be measured according to a method substantially similar to the method of measuring the particle diameter of the metal oxide particle described below.

A particle size index of the aggregate in the embodiment of the invention is preferably JIS;631 (AFS;300) or less but JIS;5 (AFS;3) or more, and more preferably JIS;355 (AFS;200) or less but JIS;31 (AFS;20) or more.

When the particle size index is equal to or less than the upper limit value described above, an excellent fluidity is obtained and the packing property in manufacturing a mold is improved. When the particle size index is equal to or more than the lower limit value described above, the breathability of the mold is maintained favorable.

Note that, in this specification, the term "particle size index" represents a particle size index measured in accordance with JIS Z 2601-1993 Annex 2 (Testing method for particle size of casting sand).

The shape of the aggregate in the embodiment of the invention is not particularly limited, and may be any shape, such as a spherical shape, a round shape, a rounded rectangle shape, a polygonal shape, a crystalline shape, or the like. From the viewpoint that an excellent fluidity is obtained, that the packing property in manufacturing a mold is improved, and that the breathability of the mold is maintained favorable, a spherical shape and a round shape are preferable, and a spherical shape is more preferable.

Particularly, as the aggregate in the embodiment of the invention, spherical artificial sand is preferable.

[Water-Soluble Binder]

From the viewpoint of favorably maintaining the shape of the mold at ordinary temperature and in a temperature region of the molten metal to be poured, a water-soluble binder is included in order to impart caking power to the aggregate.

Note that, the term "water-soluble" means soluble in water at ordinary temperature (at 20° C.). It is preferable that a mixed liquid obtained by mixing with the same volume of pure water exhibits uniform appearance under a pressure of 1 atmosphere at 20° C.

The water-soluble binder in the embodiment of the invention is not particularly limited and, for example, other than an alkali silicate, any conventionally known water-soluble binder may be used. Specific examples thereof include sodium silicate (water glass), potassium silicate, ammonium silicate, orthophosphate, pyrophosphate, trimetaphosphate, polymetaphosphate, colloidal silica, colloidal alumina, alkyl silicate, and the like. These may be used singly or two or more kinds thereof may be used.

Among these, sodium silicate (water glass) and potassium silicate are more preferable.

Here, concerning sodium silicate (water glass), sodium silicate having a molar ratio (a molecular ratio of $SiO_2.Na_2O$) of from 1.2 to 3.8 is preferable, and further, sodium silicate having a molar ratio of from 2.0 to 3.3 is more preferable. When the molar ratio is equal to or more than the lower limit value described above, there is an advantage that the change of properties of the water glass can be suppressed even after long-term storage under low temperature. When the molar ratio is equal to or less than the upper limit value described above, there is an advantage that the viscosity of the binder is easily adjusted.

As the water-soluble binder in the embodiment of the invention, polyvinyl alcohol or a derivative thereof, saponin, starch or a derivative thereof, an additional sugar, or the like can also be used.

Examples of the derivative of polyvinyl alcohol include a cation-modified polyvinyl alcohol, an anion-modified polyvinyl alcohol, a silanol-modified polyvinyl alcohol, and the like.

Examples of the derivative of starch include an oxidized starch, starch acetate, a phosphoric acid esterified starch, an acetylated starch, an etherified starch, a cationated starch, a carbamic acid esterified starch, a carboxymethylated starch, a carboxylethylated starch, a hydroxyethylated starch, a hydroxypropylated starch, dextrin, a grafted starch, a cross-linked starch, and the like.

Examples of the additional sugar include polysaccharides such as cellulose or fructose, tetrasaccharides such as acarbose, trisaccharides such as raffinose or maltotriose, disaccharides such as maltose, sucrose, or trehalose, monosaccharides such as glucose or fructose, and oligosaccharides.

As the water-soluble binder, for example, one kind from among the water-soluble binders listed above may be used singly, or two or more kinds thereof may be used in combination.

In the embodiment of the invention, a content of the water-soluble binder with respect to the aggregate is preferably set according to the kinds of the water-soluble binder and the aggregate to be used. The content is preferably from 0.1% by mass to 20% by mass, more preferably from 0.1% by mass to 10% by mass, and particularly preferably from 0.2% by mass to 5% by mass.

[Water-Soluble Foaming Agent]

Further, in manufacturing a mold using the expandable aggregate mixture according to the embodiment of the invention, it is preferable to prepare a foamed aggregate mixture by using a water-soluble foaming agent, mixing it together with an aggregate, a water-soluble binder, and the like, and stirring them to produce foam, thereby enhancing the fluidity, and then manufacture a mold.

Here, the term "water-soluble" means soluble in water at ordinary temperature (at 20° C.). It is preferable that a mixed liquid obtained by mixing with the same volume of pure water exhibits uniform appearance under a pressure of 1 atmosphere at 20° C.

Examples of the water-soluble foaming agent include surfactants (specifically, an anionic surfactant, a nonionic surfactant, an amphoteric surfactant, and the like) and the like.

Examples of the anionic surfactant include a sodium salt of a fatty acid, a monoalkyl sulfate, a linear sodium alkylbenzene sulfonate, sodium lauryl sulfate, a sodium ether sulfate, and the like.

Examples of the nonionic surfactant include a polyoxyethylene alkyl ether, a sorbitan fatty acid ester, an alkyl polyglucoside, and the like.

Examples of the amphoteric surfactant include cocamidopropyl betaine, cocamidopropyl hydroxysultaine, lauryl dimethyl aminoacetic acid betaine, and the like.

As the water-soluble forming agent, for example, one kind from among the water-soluble foaming agents listed above may be used singly, or two or more kinds thereof may be used in combination.

In the embodiment of the invention, a content of the water-soluble foaming agent with respect to the aggregate is preferably from 0.005% by mass to 0.1% by mass, and more preferably from 0.01% by mass to 0.05% by mass.

Here, the content of the water-soluble foaming agent with respect to the aggregate is preferably set according to the kinds of the water-soluble foaming agent and the aggregate to be used.

[Water]

The expandable aggregate mixture for a mold according to the embodiment of the invention contains water.

In the embodiment of the invention, a content of the water with respect to the aggregate is preferably set according to the kinds of the water-soluble binder and the aggregate to be used. The content is preferably from 1.0% by mass to 10% by mass, and more preferably from 1.5% by mass to 7.5% by mass.

[Metal Oxide Particle]

The expandable aggregate mixture for a mold according to the embodiment of the invention contains spherical metal oxide particles. Here, the term "spherical" means that the Wadell sphericity (hereinafter also referred to as, simply, "sphericity") represented by the following formula (A) is 0.6 or more (preferably 0.8 or more).

$$\text{(Sphericity)}=\text{(Surface area of a sphere having the same volume as that of the particle)}/\text{(Surface area of the particle)} \quad \text{(A)}$$

Examples of the metal oxide particle include a silica particle, an alumina particle, a zirconia particle, a titania particle, and the like. These may be used singly or two or more kinds thereof may be used. Among these, at least one of an alumina particle or a silica particle is preferable.

Further, the metal oxide particles according to the embodiment of the invention are preferably neutral or alkaline. Here, the "acidic, neutral, and alkaline metal oxide particles" used herein are defined as follows. 10 g of metal oxide particles are dispersed in 100 mL of water, and the pH of this dispersion liquid at a liquid temperature of 25° C. is measured. The pH of lower than 7 is defined as acidic, the pH of 7 is defined as neutral, and the pH of higher than 7 is defined as alkaline. With regard to the pH of metal oxide particles, it is preferable that each particle is neutral or alkaline. However, it is enough that the pH of the metal oxide particles to be used is 7 or higher as a whole, and the metal oxide particles may partially include an acidic particle.

When acidic metal oxide particles are added to the expandable aggregate mixture, gelation of the expandable aggregate mixture is accelerated, and thus it sometimes occurs that the pot life of the kneaded expandable aggregate mixture becomes short. Meanwhile, by using neutral or alkaline metal oxide particles, a foamed aggregate mixture can be used for a long term in a stable state.

Acidic, neutral, or alkaline metal oxide particles, or metal oxide particles with various pH, according to the manufacturing method or the constituent, are commercially available.

Concerning the method for manufacturing metal oxide particles, in the case of silica particles, those prepared by a dry process, for example, by a method of manufacturing silicon tetrachloride according to the flame fusion method, become acidic, since the remaining chlorine produces hydrochloric acid in an aqueous solution. Further, whether or not those prepared by a wet process exhibit acidic, neutral, or alkaline characteristics depend on the pH of the solution used. For example, by a manufacturing method according to the precipitation method, neutral to alkaline silica particles are mainly produced. Further, for example, by a manufacturing method according to the gelation method, there is a tendency that acidic to neutral silica particles are mainly produced.

Further, concerning the method for manufacturing metal oxide particles, in the case of alumina particles, by a manufacturing method according to the VMC method, for example, by a manufacturing method utilizing a deflagration phenomenon of metal powder, neutral alumina particles are obtained.

From the viewpoint of reducing the adhesion of sand to the surface of the cast product, the particle diameter of the metal oxide particle according to the embodiment of the invention is preferably from 0.1 μm to 5 μm, more preferably from 0.2 μm to 2 μm, and still more preferably from 0.5 μm to 1 μm.

The particle diameter described above represents a volume average particle diameter and, in this specification, represents a particle diameter measured by the following method.

A laser diffraction particle size distribution analyzer SALD2100 (trade name), manufactured by Shimadzu Corporation is used as an apparatus for measuring the particle diameter. The measurement conditions are as follows. A dispersion liquid in which 5% by mass of sodium hexametaphosphate (manufactured by Kishida Chemical Co., Ltd., first grade) as a dispersant is added to pure water is prepared. The metal oxide particles are added to the dispersion liquid, and the mixture is subjected to an ultrasonic treatment for 5 minutes in an ultrasonic bath (vibration frequency: 38 kHz, 100 W) attached to the apparatus. The particle size of the resultant is measured using the above laser diffraction particle size distribution analyzer SALD2100 under the condition of a refractive index of 1.70-0.20i.

[Additional Component]

Further, other than the above compositions, a conventionally known component such as a catalyst, an oxidation accelerator, or the like can be added to the expandable aggregate mixture for a mold according to the embodiment of the invention.

[Kneading Method]

The expandable aggregate mixture for a mold according to the embodiment of the invention is manufactured by mixing the components described above. The order of the addition and the method of kneading are not particularly limited.

As a kneading apparatus used when kneading the above-described components, a conventionally known kneading apparatus may be used without any particular limitation. For example, a planetary centrifugal mixer, an EIRICH intensive mixer, a Sinto Simpson's "Mix Muller", or the like may be used.

[Manufacturing Method for Aggregate Mold]

The manufacture of the mold (the aggregate mold) using the expandable aggregate mixture for a mold according to the embodiment of the invention may be manufacture using a molding machine or may be manufacture by benching molding.

However, it is preferable to prepare a foamed-state aggregate mixture by mixing and stirring the above-described various components to produce foam, and then manufacture a mold by filling a space (cavity) for manufacturing a mold in a heated metal mold for manufacturing a mold with the obtained foamed-state aggregate mixture by press fitting. In the press fitting, it is more preferable that filling is performed by injection.

More specifically, it is preferable to manufacture the mold by the manufacturing method including the following processes a) to c).

a) a filling process of filling a space for manufacturing a mold in a metal mold with an expandable aggregate mixture for a mold, the expandable aggregate mixture including an aggregate, a water-soluble binder, a water-soluble foaming agent, water, and spherical metal oxide particles, in which the filling of the space for manufacturing a mold is performed by injection;

b) a mold manufacturing process of manufacturing an aggregate mold by evaporating the moisture from the expandable aggregate mixture that has been filled, to solidify the expandable aggregate mixture; and c) a removal process of removing the aggregate mold, that has been manufactured, from the space for manufacturing a mold.

Further, from the viewpoint of uniformly dispersing each component in the expandable aggregate mixture, the following expandable aggregate mixture preparation process is included before the filling process.

An expandable aggregate mixture preparation process of preparing an expandable aggregate mixture by mixing a mixture obtained by mixing the water-soluble binder and the metal oxide particles, an aggregate, a surfactant, and water.

In the expandable aggregate mixture for a mold packed by press fitting into the space for manufacturing a mold in a metal mold that has been heated to high temperature, a phenomenon in which the foam, which has been dispersed in the expandable aggregate mixture for a mold by stirring, and the water vapor, which is generated from the moisture in the expandable aggregate mixture by the heat of the heated metal mold, are accumulated in the center portion (inner portion) of the mold is caused. As a result, the mold has a low packing density of the aggregate, the water-soluble binder, the water-soluble foaming agent, and the metal oxide particles (that is, the density of the solid content) in the inner portion, whereas the mold has a high packing density of the aggregate, the water-soluble binder, the water-soluble foaming agent, and the metal oxide particles (the density of the solid content) at the surface.

As described above, in the mold according to the embodiment of the invention, the water-soluble binder and the metal oxide particles are specifically disposed at the outer peripheral surface side (at the surface side).

Since the metal oxide particles are specifically disposed at the outer peripheral surface side of the mold together with the water-soluble binder, these metal oxide particles exhibit a lotus effect with respect to the surface of the cast product and, as a result, the adhesion of the aggregate (sand) to the surface of the cast product by the water-soluble binder can be reduced.

Taking into consideration that it is enough that the water-soluble binder, which contributes to the strength and the surface quality of the mold, is specifically disposed at the surface of the mold, the amount of the water-soluble binder to be used can be suppressed, compared with a conventional mold in which the water-soluble binder is not specifically disposed at the outer peripheral surface side.

Further, in the embodiment of the invention, since it is enough that the metal oxide particles disposed at the surface of the mold, the amount of the metal oxide particles to be used can be suppressed, compared with a conventional mold in which metal oxide particles are added in order to enhance the strength of the mold, that is, a conventional mold in which the metal oxide particles are not specifically disposed at the outer peripheral surface side.

In addition, it is thought that, in the expandable aggregate mixture, the metal oxide particle according to the embodiment of the invention plays a role of a roller (a rolling element) that makes the flow smooth. Accordingly, the metal oxide particle can contribute to the enhancement of the packing density of the expandable aggregate mixture, which is advantageous from the viewpoint of improving the strength of the mold.

With regard to the mold according to the embodiment of the invention, the fact that the water-soluble binder and the metal oxide particles are specifically disposed at the outer peripheral surface side can be confirmed according to the method described below.

With regard to the mold, the fact that the water-soluble binder and the metal oxide particles are specifically disposed at the outer peripheral surface side of the mold can be confirmed by measuring the densities of the water-soluble binder and the metal oxide particle.

Specifically, the method of measuring the densities of the water-soluble binder and the metal oxide particle is as follows. First, samples of the surface and the inner portion of the mold are collected. As to the method of collecting the samples, slices having the same volume are collected from each of the surface side and the inner portion side of the mold. By measuring the densities of the water-soluble binder and the metal oxide particle in each of the obtained slices of the surface side and the inner portion side, whether the water-soluble binder and the metal oxide particles are specifically disposed at the outer peripheral surface side of the mold or not can be confirmed.

Further, with regard to the mold, whether the density of the solid content in the inner portion is lower or not than the density of the solid content at the surface may be determined by visually confirming the degree of packing of the solid content (the aggregate, the water-soluble binder, the water-soluble foaming agent, and the metal oxide particles) at the surface and the inner portion, in a cross section of the mold.

In order to improve the packing property with respect to the space for manufacturing a mold and to improve the packing density described above, it is preferable to foam the expandable aggregate mixture for a mold by stirring, until whipped creamy. More specifically, the viscosity of the expandable aggregate mixture for a mold (that is, the aggregate mixture for a mold, which has been stirred) is preferably from 0.5 Pa·s to 10 Pa·s, and the viscosity is more preferably from 0.5 Pa·s to 8 Pa·s.

Measurement of the viscosity of the expandable aggregate mixture for a mold (that is, the aggregate mixture for a mold, which has been stirred) is performed as described below.

—Measurement Method—

The expandable aggregate mixture for a mold is charged into a cylindrical container having an inside diameter of 42 mm and having a pore with a diameter of 6 mm at the bottom. The expandable aggregate mixture for a mold is discharged from the pore when pressurized with one's own weight of a cylindrical weight having a weight of 1 kg and a diameter of 40 mm. In this process, the duration of time required for the weight to travel 50 mm is measured, and the viscosity is determined according to the following equation. Here, the temperature at the time of measuring the viscosity is set at 25° C.

$$\mu=\pi D^4 P_p t/128 L_1 L_2 S \qquad \text{Equation}$$

μ: viscosity [Pa·s]

D: diameter of the pore at the bottom [m]

$P_p$: pressure of the weight [Pa]

t: duration of time required for the weight to travel 50 mm [s]

$L_1$: travel distance of the weight (=50 mm)

$L_2$: plate thickness of the pore at the bottom [m]

S: average value of an area of the bottom of the cylindrical weight and a cross-sectional area of the hollow region (that is, the inside part) inside of the cylindrical container [$m^2$]

Examples of a method of filling the space (cavity) for manufacturing a mold with the expandable aggregate mixture for a mold include direct pressurization using a piston in a cylinder, filling by supplying compressed air to inside a cylinder, pressure feeding using a screw or the like, slushing, and the like. From the viewpoints of the packing speed and the packing stability by applying uniform pressure to the expandable aggregate mixture, direct pressurization using a piston and filling by supplying compressed air are preferable.

Vaporization of the moisture in the expandable aggregate mixture for a mold, which has been packed into the space (cavity) for manufacturing a mold, is performed, for example, by heat from the heated metal mold, flow of heated air to the space (cavity) for manufacturing a mold, a combination thereof, or the like.

[Manufacture of Cast Product Using Mold]

The mold employing the expandable aggregate mixture for a mold according to the embodiment of the invention is used for casting various metals or alloys. Examples of a material of a molten metal used for casting include the followings. Note that, the pouring temperature described below represents a temperature at which the material described below melts to an extent appropriate for pouring.

Aluminum or an aluminum alloy (pouring temperature: from 670° C. to 700° C.)

Iron or an iron alloy (pouring temperature: from 1300° C. to 1400° C.)

Bronze (pouring temperature: from 1100° C. to 1250° C.)

Brass (pouring temperature: from 950° C. to 1100° C.)

The casting is conducted by pouring a molten metal of a material as listed above to the spaces in the mold (core) and the metal mold, and then cooling them to remove the mold.

EXAMPLES

Hereinafter, an embodiment of the present invention is specifically described with reference to Examples; however, the embodiment of the invention is by no means limited to the following Examples. In the following, "part(s)" represents "part(s) by mass", unless otherwise stated.

Example 1

The materials in the composition shown in Table 1 were mixed using a mixer (a table top mixer, manufactured by AICOHSHA MFG. CO., LTD.) by stirring at about 200 rpm for about 5 minutes to produce foam, thereby preparing an expandable aggregate mixture.

TABLE 1

| | | |
|---|---|---|
| Aggregate | Spherical artificial sand (ESPEARL#60 (trade name) manufactured by Yamakawa Sangyo Co., Ltd.) | 100 parts by mass |
| Water-soluble binder | Sodium silicate (1-59 (trade name) manufactured by FUJI CHEMICAL Industries Inc.) | 2.0 parts by mass |
| Water-soluble foaming agent | Anionic surfactant (PERSOFT EF (trade name) manufactured by NOF CORPORATION, sodium salt of ether sulfate) | 0.05 parts by mass |
| Water | Distilled water | 3.0 parts by mass |
| Metal oxide particles | Spherical alumina particles (AO-502 (trade name) manufactured by ADMATECHS COMPANY, neutral, particle size: 0.7 μm) | 0.05 parts by mass |

Then, this expandable aggregate mixture was injected into a metal mold heated to 250° C. using an injection device on the conditions of a gate speed of 1 m/sec and a cylinder face pressure of 0.4 MPa. This metal mold is a metal mold for manufacturing a mold for a bending test, and has a space (cavity) with a volume of about 80 $cm^3$.

The expandable aggregate mixture that had been packed into the heated metal mold was allowed to stand for 2 minutes, to vaporize the moisture by the heat of the metal mold, thereby solidifying the expandable aggregate mixture.

Thereafter, the mold (core) was removed from the cavity in the metal mold.

From this mold, specimens for a bending test having a size of 10 mm×10 mm×70 mm were prepared, and the mass (weight) and the bending strength of these specimens were measured. The measurement of the bending strength was conducted in accordance with JACT TEST METHOD SM-1, "Bending strength testing method".

Further, using this mold, a cast product was prepared, and after performing sand shakeout operation, the amount of the sand adhered to the surface of the cast product was measured. The measurement results are shown in FIG. 1A to FIG. 1C.

Comparative Example 1

A mold was obtained in a manner substantially similar to that in Example 1, except that, in the composition shown in Table 1, the materials of a composition that does not include metal oxide particles (spherical alumina particles) were used, and then, similar tests were conducted. The measurement results are shown in FIG. 1A to FIG. 1C.

Figure 1B:
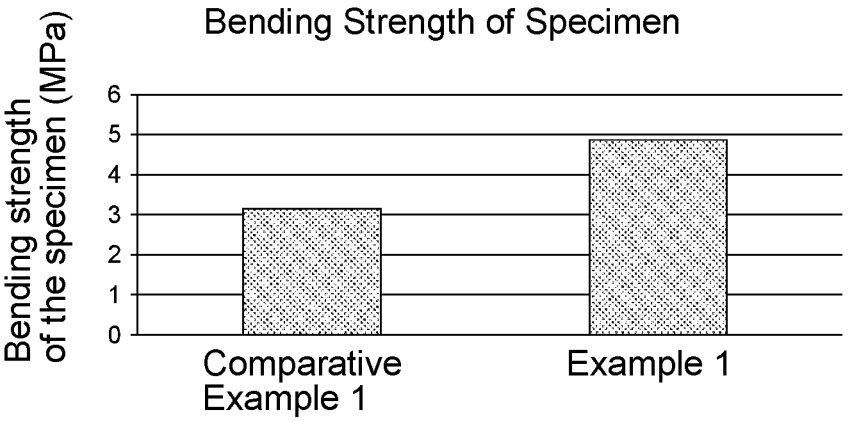
FIG. 1B is a graph showing the results of a bending strength test in Example 1 and Comparative Example 1.
Figure 1C:
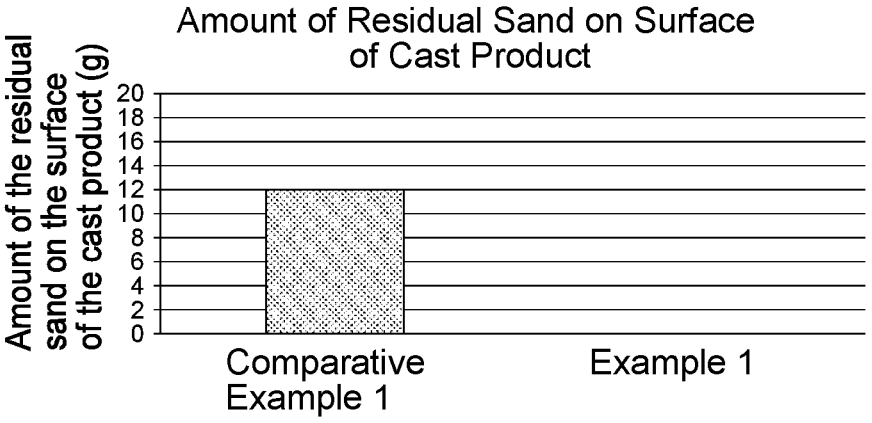
FIG. 1C is a graph showing the measurement results of the amount of residual sand on the surface of the cast product in Example 1 and Comparative Example 1.

As shown in FIG. 1A, as the results of the weight measurement with regard to the specimens, the weight of the specimen obtained in Example 1 was increased by about 10%, as compared with the case of not containing the spherical alumina particles.

Further, as shown in FIG. 1B, as the results of the bending strength measurement with regard to the specimens, the bending strength of the specimen obtained in Example 1 was improved to achieve about 1.5 times, as compared with the case of not containing the spherical alumina particles.

Further, as shown in FIG. 1C, as the results of the measurement of the amount of the residual sand on the surface of the cast product that had been casted and had been subjected to sand shakeout operation, the amount of the residual sand was 12 g in the case of not containing the spherical alumina particles, whereas the amount of the residual sand was 0 g in the case of the specimen obtained in Example 1.

According to the method described above, slices having the same volume were collected from each of the surface and the inner portion of the mold, and the densities of the water-soluble binder and the metal oxide particle (spherical alumina particle) in each of the slices were measured. As a result, it was found that the densities of the water-soluble binder and the metal oxide particle (spherical alumina particle) in the slice collected from the surface side were higher than those in the slice collected from the inner portion side.

Example 2

Figure 2A:
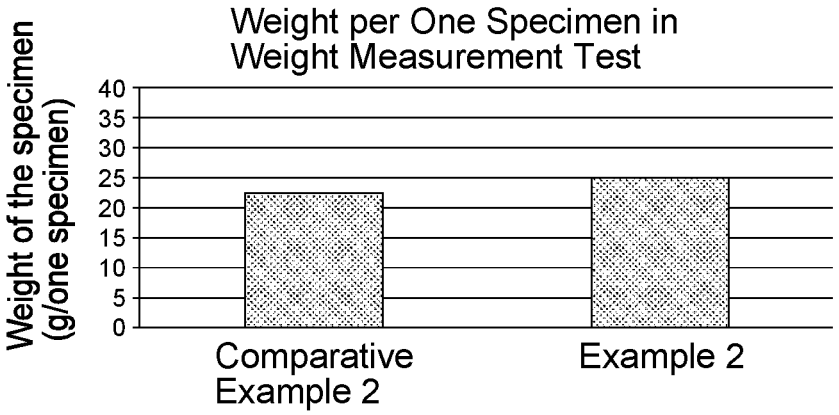
FIG. 2A is a graph showing the results of a weight measurement test in Example 2 and Comparative Example 2.
Figure 2B:
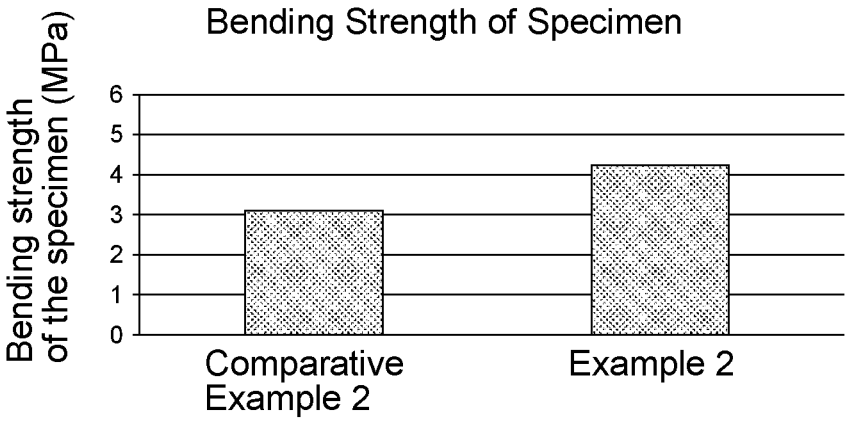
FIG. 2B is a graph showing the results of a bending strength test in Example 2 and Comparative Example 2.
Figure 2C:
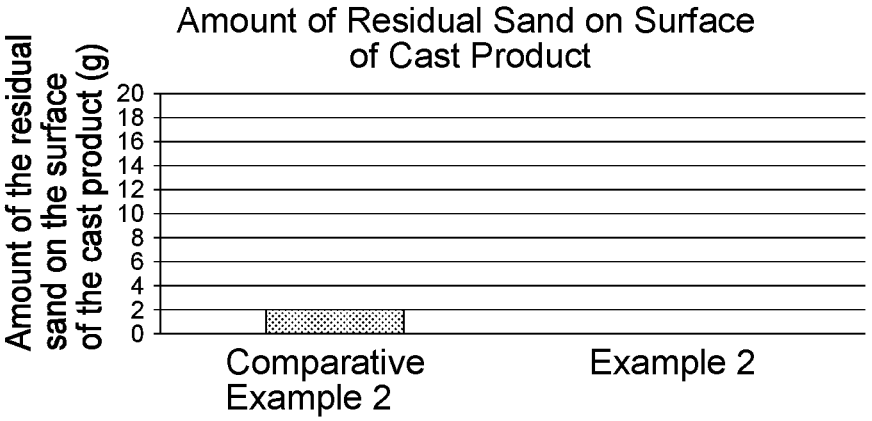
FIG. 2C is a graph showing the measurement results of the amount of residual sand on the surface of the cast product in Example 2 and Comparative Example 2.

A mold was obtained in a manner substantially similar to that in Example 1, except that the materials in the composition shown in Table 2 were used, and then, similar tests were conducted. The measurement results are shown in FIG. 2A to FIG. 2C.

TABLE 2

| | | |
|---|---|---|
| Aggregate | Spherical artificial sand (CERABEADS#650 (trade name) manufactured by ITOCHU CERATECH CORPORATION) | 100 parts by mass |
| Water-soluble binder | Polyvinyl alcohol (JF-05 (trade name) manufactured by JAPAN VAM POVAL CO., LTD) | 1.0 parts by mass |
| Water-soluble foaming agent | Anionic surfactant (PERSOFT EF (trade name) manufactured by NOF CORPORATION, sodium salt of ether sulfate) | 0.05 parts by mass |
| Water | Distilled water | 3.5 parts by mass |
| Metal oxide particles | Spherical silica particles (SPF30F (trade name) manufactured by DENKA CO., Ltd., neutral, particle size 0.6 μm) | 0.05 parts by mass |

Comparative Example 2

A mold was obtained in a manner substantially similar to that in Example 2, except that, in the composition shown in Table 2, the materials of a composition that does not include metal oxide particles (spherical silica particles) were used, and then, similar tests were conducted. The measurement results are shown in FIG. 2A to FIG. 2C.

As shown in FIG. 2A, as the results of the weight measurement with regard to the specimens, the weight of the specimen obtained in Example 2 was increased by about 10%, as compared with the case of not containing the spherical silica particles.

Further, as shown in FIG. 2B, as the results of the bending strength measurement with regard to the specimens, the bending strength of the specimen obtained in Example 2 was improved to achieve about 1.5 times, as compared with the case of not containing the spherical silica particles.

Further, as shown in FIG. 2C, as the results of the measurement of the amount of the residual sand on the surface of the cast product that had been casted and had been subjected to sand shakeout operation, the amount of the residual sand was 2 g in the case of not containing the spherical silica, whereas the amount of the residual sand was 0 g in the case of the specimen obtained in Example 2.

According to the method described above, slices having the same volume were collected from each of the surface and the inner portion of the mold, and the densities of the water-soluble binder and the metal oxide particle (spherical silica particle) in each of the slices were measured. As a result, it was found that the densities of the water-soluble binder and the metal oxide particle (spherical silica particle) in the slice collected from the surface side were higher than those in the slice collected from the inner portion side.

The disclosure of Japanese Patent Application No. 2017-216183 filed on Nov. 9, 2017 is incorporated by reference herein in its entirety.

All publications, patent applications, and technical standards mentioned in this specification are herein incorporated by reference to the same extent as if such individual publication, patent application, or technical standard was specifically and individually indicated to be incorporated by reference.

What is claimed is:

1. An expandable aggregate mixture for a mold, the expandable aggregate mixture comprising an aggregate, a water-soluble binder, a water-soluble foaming agent, water, and spherical metal oxide particles, wherein the metal oxide particles are neutral or alkaline.

2. The expandable aggregate mixture for a mold according to claim 1, comprising, as the metal oxide particles, at least one selected from the group consisting of an alumina particle and a silica particle.

3. The expandable aggregate mixture for a mold according to claim 1, wherein the metal oxide particles have a particle diameter of from 0.1 μm to 5 μm.

4. The expandable aggregate mixture for a mold according to claim 1, comprising, as the aggregate, spherical artificial sand.

5. The expandable aggregate mixture for a mold according to claim 1, comprising, as the water-soluble binder, an alkali silicate.

6. The expandable aggregate mixture for a mold according to claim 5, comprising, as the water-soluble binder, at least one selected from the group consisting of sodium silicate and potassium silicate.

7. The expandable aggregate mixture for a mold according to claim 1, comprising, as the water-soluble binder, at least one selected from the binder group consisting of polyvinyl alcohol and derivatives thereof, saponin, starch and derivatives thereof, and additional sugars.

8. The expandable aggregate mixture for a mold according to claim 1, wherein the water-soluble foaming agent comprising at least one selected from the group consisting of an anionic surfactant, a nonionic surfactant, and an amphoteric surfactant.

9. The expandable aggregate mixture for a mold according to claim 1, wherein a content of the metal oxide particles is from 0.001% by mass to 0.5% by mass with respect to the aggregate.

10. The expandable aggregate mixture for a mold according to claim 1, wherein a content of the water-soluble binder is from 0.1% by mass to 20% by mass with respect to the aggregate.

11. The expandable aggregate mixture for a mold according to claim 1, wherein a content of the water-soluble foaming agent is from 0.005% by mass to 0.1% by mass with respect to the aggregate.

12. The expandable aggregate mixture for a mold according to claim 1, wherein a content of the water is from 1.0% by mass to 10% by mass with respect to the aggregate.

13. The expandable aggregate mixture for a mold according to claim 1, having a viscosity of from 0.5 Pa·s to 10 Pa·s.

14. The expandable aggregate mixture for a mold according to claim 1, comprising, as the metal oxide particles, at least one selected from the group consisting of an alumina particle and a silica particle, the metal oxide particles having a particle diameter of from 0.1 μm to 5 μm, and comprising, as the aggregate, spherical artificial sand.

15. The expandable aggregate mixture for a mold according to claim 14, having a viscosity of from 0.5 Pa·s to 10 Pa·s, wherein a content of the metal oxide particles is from 0.001% by mass to 0.5% by mass with respect to the aggregate, a content of the water-soluble binder is from 0.1% by mass to 20% by mass with respect to the aggregate, a content of the water-soluble foaming agent is from 0.005% by mass to 0.1% by mass with respect to the aggregate, and a content of the water is from 1.0% by mass to 10% by mass with respect to the aggregate.

16. A mold, comprising the expandable aggregate mixture for a mold according to claim 1, in which the water-soluble binder and the metal oxide particles are specifically disposed at an outer peripheral surface side the mold.

17. A method for manufacturing a mold, the method comprising:

a filling process of filling a space for manufacturing a mold in a metal mold with the expandable aggregate mixture for a mold according to claim 1, in which the filling of the space for manufacturing a mold is performed by injection;

a mold manufacturing process of manufacturing an aggregate mold by evaporating moisture from the expandable aggregate mixture that has been filled, to solidify the expandable aggregate mixture;

a removal process of removing the aggregate mold, that has been manufactured, from the space for manufacturing a mold; and before the filling process, an expandable aggregate mixture preparation process of preparing an expandable aggregate mixture by mixing a mixture obtained by mixing the water-soluble binder and the metal oxide particles, an aggregate, a surfactant and water.

18. A mold, comprising the expandable aggregate mixture for a mold according to claim 15, in which the water-soluble binder and the metal oxide particles are specifically disposed at an outer peripheral surface side of the mold.

19. A method for manufacturing a mold, the method comprising:

a filling process of filling a space for manufacturing a mold in a metal mold with the expandable aggregate mixture for a mold according to claim 15, in which the filling of the space for manufacturing a mold is performed by injection;

a mold manufacturing process of manufacturing an aggregate mold by evaporating moisture from the expandable aggregate mixture that has been filled, to solidify the expandable aggregate mixture;

a removal process of removing the aggregate mold, that has been manufactured, from the space for manufacturing a mold; and before the filling process, an expandable aggregate mixture preparation process of preparing an expandable aggregate mixture by mixing a mixture obtained by mixing the water-soluble binder and the metal oxide particles, an aggregate, a surfactant and water.

* * * * *